US009072361B1

(12) United States Patent
Aravena

(10) Patent No.: US 9,072,361 B1
(45) Date of Patent: Jul. 7, 2015

(54) TACTICAL MAGNETIC KEEPER

(76) Inventor: Cristian Marcelo Aravena, Miami, FL (US)

( * ) Notice: Subject to any disclaimer, the term of this patent is extended or adjusted under 35 U.S.C. 154(b) by 79 days.

(21) Appl. No.: 13/471,039

(22) Filed: Jun. 15, 2012

Related U.S. Application Data

(60) Provisional application No. 61/686,176, filed on Apr. 2, 2012.

(51) Int. Cl.
*F41C 33/00* (2006.01)
*A45F 5/00* (2006.01)
*A45F 5/02* (2006.01)

(52) U.S. Cl.
CPC . *A45F 5/00* (2013.01); *A45F 5/021* (2013.01); *A45F 2200/0591* (2013.01)

(58) Field of Classification Search
CPC .... A45F 5/00; A45F 5/021; A45F 2200/0591
USPC ..... 224/183, 587, 675, 914, 665–667, 911, 224/912; 248/683, 206.5; 24/303
See application file for complete search history.

(56) References Cited

U.S. PATENT DOCUMENTS 2,910,804 A * 11/1959 White ..... 446/28
4,736,877 A 4/1988 Clark
5,458,267 A * 10/1995 Curtis et al. ..... 224/675
6,213,364 B1 * 4/2001 Wakefield ..... 224/587
2003/0178455 A1 * 9/2003 Rugh ..... 224/269
2005/0199663 A1 9/2005 Heaton et al.
2008/0185414 A1 8/2008 Conlon
2009/0314813 A1 * 12/2009 Woolery ..... 224/183

OTHER PUBLICATIONS

"DAA Magnetic Magazine Pouch", Internet Archive WayBackMachine, Feb. 11, 2012.
"DAA Magnetic Magazine Pouch", www.youtube.com/watch?v=KmgBx13jOEU, Oct. 6, 2010.
"DAA Magnetic Magazine Pouch", Google Search Results, searched May 19, 2014.
"Introducing The Belt Mounted Ammo Holder by Montie Gear", http://slingshotforum.com, Sep. 2013.

* cited by examiner

*Primary Examiner* — Adam Waggenspack
(74) *Attorney, Agent, or Firm* — Wright IP & International Law; Eric G. Wright

(57) ABSTRACT

This invention provides faster responds times to immediate actions that need to be performed when in a gun fight. Traditional methods in the Law Enforcement community teach to either discard a weapon in case an assailant attacks or deal with a weapons malfunction in some sort of awkward method. The Tactical Magnetic Keeper allows the weapons operator to more efficiently maneuver through hostile situations than traditional methods. A weapons operator can magnetize his or her weapon, magazine, baton, flashlight, hand cuffs, hand cuff key and knife in the event of a violent encounter. The Tactical Magnetic Keeper is a belt clip which holds three Neodymium (NdFeb) Grade magnets in the front of the clip and one on the bottom half of the back side of the clip. The weapons operator can utilize a Tactical Magnetic Keeper on the front of their gun belt and one on the back side.

10 Claims, 4 Drawing Sheets

TACTICAL MAGNETIC KEEPER

CROSS-REFERENCE TO RELATED APPLICATIONS

Cross reference to related application: This application claims benefits of provisional application 61/686,176 filed on Apr. 2, 2012.

BACKGROUND OF THE INVENTION

Traditional methods in the Law Enforcement community teach to either discard a weapon in case an assailant attacks or deal with a weapons malfunction in some sort of awkward method.

BRIEF DESCRIPTION OF THE DRAWINGS

FIG. 6 shows an embodiment having approximate dimensions of 3½ inches high, ⅝ inch in width and 2¼ inches in length.

DETAILED DESCRIPTION OF THE INVENTION

This invention provides faster response times to immediate actions that need to be performed when in a gun fight. The Tactical Magnetic Keeper 1 allows the weapons operator to more efficiently maneuver through hostile situations than traditional methods. A weapons operator can magnetize his or her weapon, magazine, baton, flashlight, hand cuffs, hand cuff key and knife in the event of a violent encounter. The Tactical Magnetic Keeper 1 is a belt clip which holds three Neodymium (NdFeb) Grade magnets in the front of the clip 50 and one on the bottom half of the back side of the clip. The weapons operator can utilize a Tactical Magnetic Keeper on the front of their gun belt and one on the back side.

Figure 1:
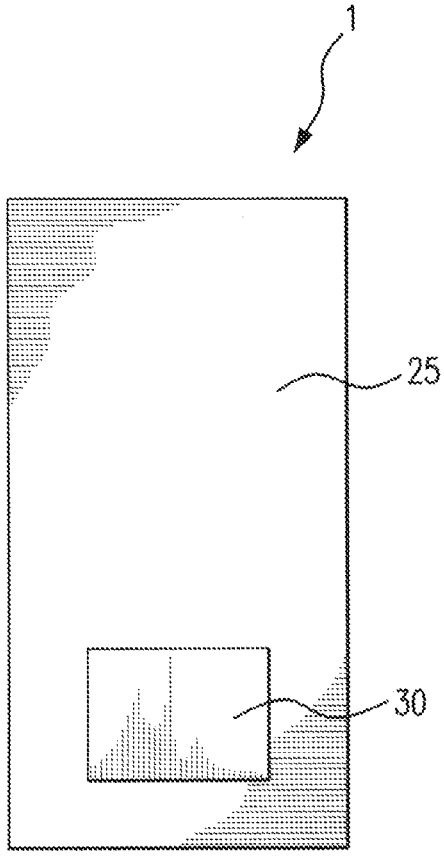
FIG. 1 illustrates a rear view at actual size of a tactical magnetic keeper having a metal clip and a neodymium grade magnet.

FIG. 1 is a semi-diagrammatic view of the rear view of a magnetized belt clip according to one embodiment of the invention.

Figure 2:
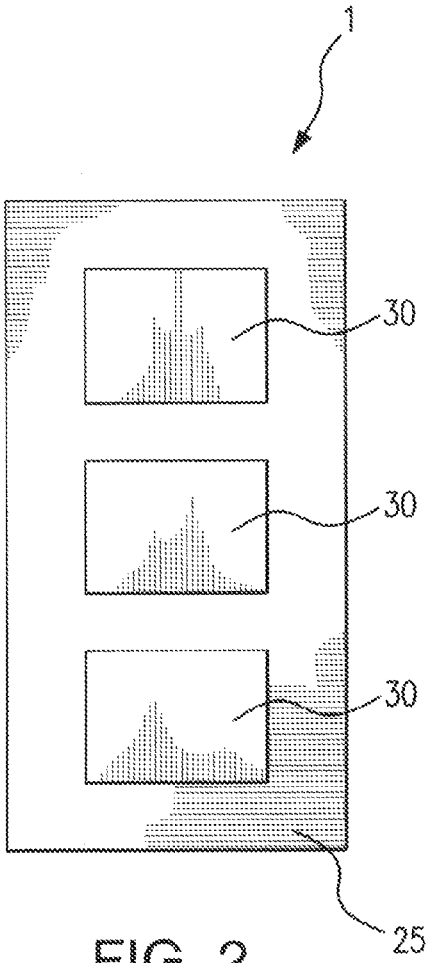
FIG. 2 illustrates a frontal view of a tactical magnetic keeper having a metal clip and a neodymium grade magnet. The tactical magnetic keeper can also be made of plastic or nylon.

FIG. 2 is a frontal view of the clip showing three strategically placed magnets.

Figure 3:
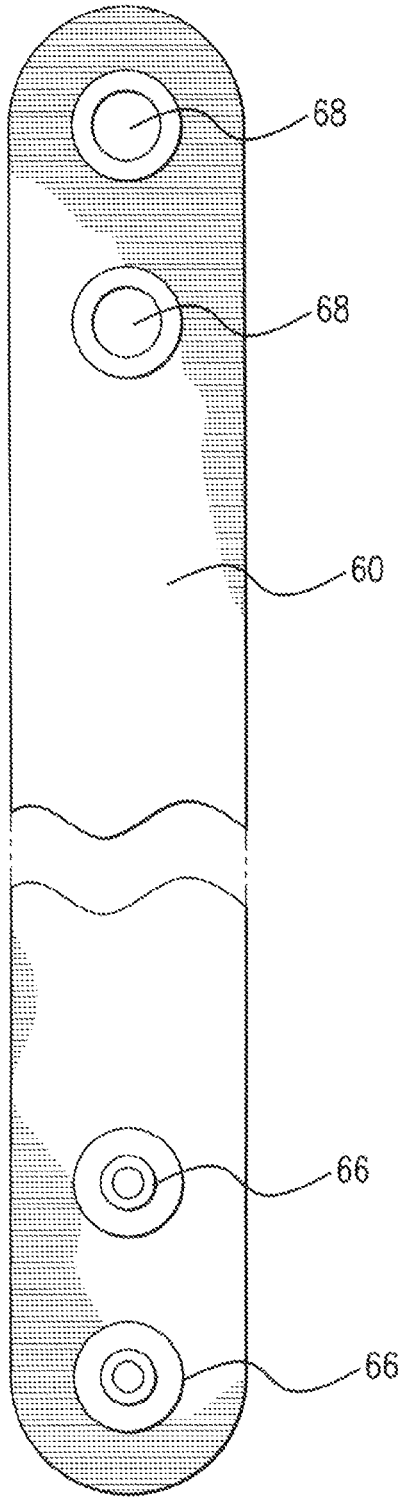
FIG. 3 illustrates an open belt keeper mode of a tactical magnetic keeper.

FIG. 3 is a semi-diagrammatic view of the under part view of a magnetized belt keeper according to one embodiment of the invention.

Figure 4:
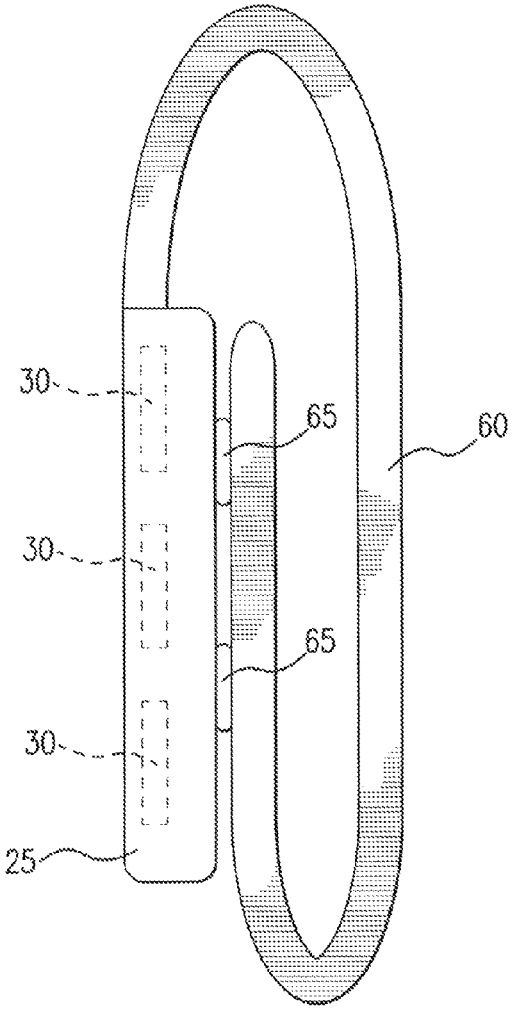
FIG. 4 illustrates a closed side view of a tactical magnetic keeper having three neodymium grade magnetics in a portion and one neodymium magnet in another portion.

FIG. 4 is a closed view of the keeper showing three strategically placed magnets on one side while another is placed on the other lower side.

Figure 5:
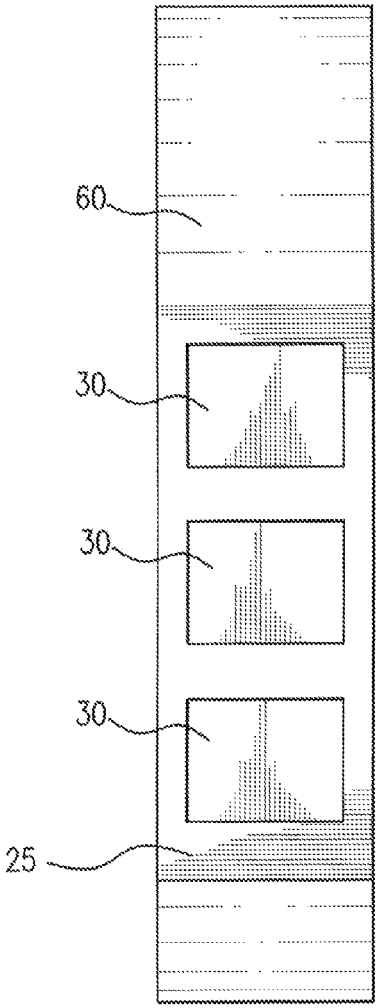
FIG. 5 illustrates a frontal view closed mode of a tactical magnetic keeper having a neodymium magnet and which can be made of leather, plastic or nylon.
Figure 6:
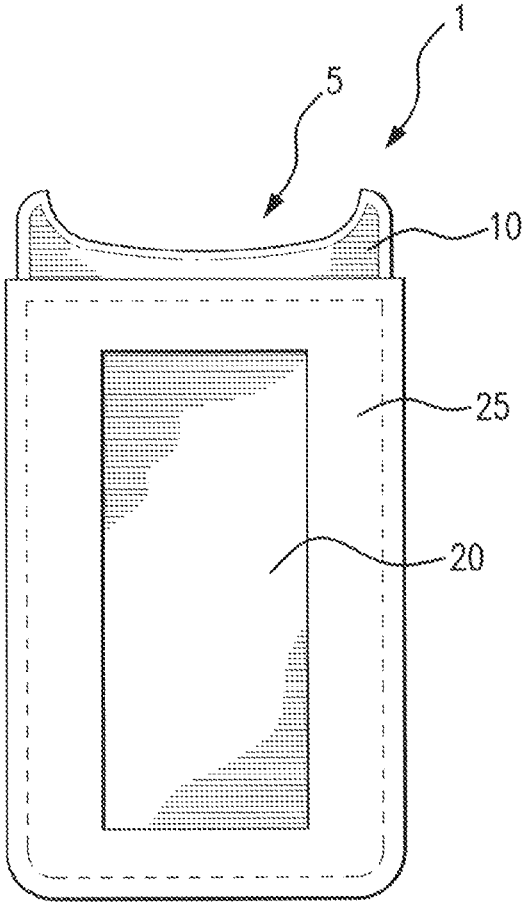
FIG. 6 illustrates a frontal view of a tactical magnetic keeper having a magnet, a black polymer or plastic portion, a black leather or nylon or plastic cover with stitching.
Figure 7:
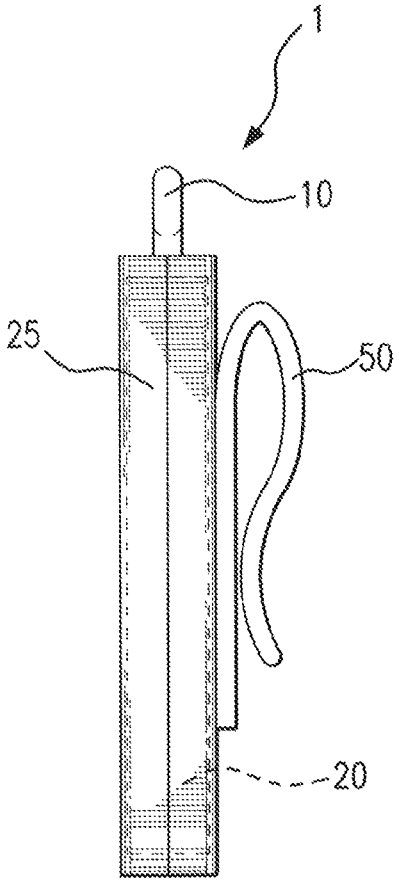
FIG. 7 illustrates a side view of the tactical magnetic keeper of FIG. 6 having a belt clip and stitching.

FIG. 5 is a frontal view of the closed keeper showing three strategically placed magnets.

The Tactical Magnetic Keeper 1 ("TM Keeper") is a tactical belt keeper or duty belt 60 apparatus for the Law Enforcement Officer or any person utilizing a duty belt 60. Its capabilities and/or uses are as follows:

One version has a U shape cut out on top 10 of the TM Keeper 1 which is utilized for the stripping or ripping out of a firearms magazine or ammunition clip when a malfunction in the weapon is apparent. The operator of the weapon slides the stalk of the clip onto the U shape structure 5 and rips away, therefore, releasing the jammed ammunition clip or magazine.

Inside the TM Keeper 1, lye strong magnetic cubes 20, 30 (Neodymium (NdFeb) Grade) which are utilized for numerous occasions while the weapons operator is engaged in a firelight, which include:

When performing a tactical reload, instead of placing the semi-spent ammunition clip in a pant pocket or behind the duty belt 60, the weapons operator simply places the clip on the TM Keeper 1.

In an instance where the weapons operator has the capability of only one arm and hand, he or she can place their handgun on the TM Keeper 1 and perform a magazine and/or ammunition clip exchange. (magazine is another term used for ammunition clip)

When a weapon operator is moving through a low light area with his or her weapon and flashlight, he or she can place their flashlight on the TM Keeper 1 before entering a lit area and then come back to the flashlight quickly if needed.

When a weapon operator is retaining an assailant's weapon in a hostile situation, the operator can place the assailant's weapon on the TM Keeper 1.

If for some reason an operator can not handcuff an assailant, he can place the cuffs on the TM Keeper and later come back to them.

The TM Keeper can also be clipped onto an SRT or SWAT (tactical) vest.

The TM Keeper can also be utilized as a handcuff carrier. Each cuff is placed on each side of the keeper where there is a magnet in place.

The TM Keeper can also hold a gun which is placed inside the pants without a holster.

The TM Keeper can also hold a cuff key/baton/knife or any metal or steel object.

The embodiments of the invention in which an exclusive property or privilege is claimed are defined as follows:

1. A keeper for a handgun which is a firearm, comprising:

an attaching portion having an attaching means adapted to reversibly secure said keeper to a belt;

a support for a plurality of neodymium magnets;

said plurality of neodymium magnets supported by said support, said plurality of neodymium magnets having at least a first neodymium magnet and a second neodymium magnet, said first neodymium magnet configured to magnetically attract a first portion of said handgun and said second neodymium magnet configured to magnetically attract a second portion of said handgun, said at least said first neodymium magnet and said second neodymium magnet configured to reversibly secure said handgun which has a removable magazine, said magnetic attraction from said at least said first neodymium magnet and said second neodymium magnet to the metal of the handgun being sufficient to fully support the weight of the handgun which has a removable magazine;

said at least said first neodymium magnet and said second neodymium magnet reversibly securing the handgun to the keeper when said handgun which is a firearm is fully supported by the keeper;

a member having a U-shaped portion adapted for reversible engagement of a firearms magazine or an ammunition clip in a state in which the firearms magazine or the ammunition clip is loaded into said handgun, said U-shaped portion being located on a different face of the support than the attaching portion, said magazine stalk having a first width and a second width, said U-shaped portion configured to reversibly receive at least one of said first width and said second width of a stalk of said firearms magazine or said ammunition clip;

said U-shaped portion configured to reversibly engage at least one of said first width and said second width of said stalk during a removal of said firearms magazine or ammunition clip from said handgun to a state in which the firearms magazine or ammunition clip is not loaded into a handgun.

2. The keeper of claim 1, in which said plurality of neodymium magnets are configured to magnetically attract and reversibly secure an ammunition clip.

3. The keeper of claim 1, in which said plurality of neodymium magnets are configured to magnetically attract and reversibly secure a magazine for a weapon.

4. The keeper of claim 1, in which said plurality of neodymium magnets are configured to magnetically attract and reversibly secure a flashlight.

5. The keeper of claim 1, in which said plurality of neodymium magnets are configured to magnetically attract and reversibly secure a set of handcuffs.

6. The keeper of claim 1, in which said plurality of neodymium magnets are configured to magnetically attract and reversibly secure a key.

7. The keeper of claim 1, in which said plurality of neodymium magnets are configured to magnetically attract and reversibly secure a baton.

8. The keeper of claim 1, in which said plurality of neodymium magnets are configured to magnetically attract and reversibly secure a knife.

9. The keeper of claim 1, in which said attaching portion comprises a belt clip adapted to reversibly secure said keeper to said belt.

10. The keeper of claim 1, in which said attaching portion comprises a flexible portion which loops around a portion of said belt and which is adapted to reversibly secure said keeper to said belt.

* * * * *